US006173826B1

(12) United States Patent
Furneaux

(10) Patent No.: US 6,173,826 B1
(45) Date of Patent: Jan. 16, 2001

(54) METHOD AND APPARATUS FOR VALIDATING COINS

(75) Inventor: David Michael Furneaux, Reading (GB)

(73) Assignee: Mars Incorporated, McLean, VA (US)

( * ) Notice: Under 35 U.S.C. 154(b), the term of this patent shall be extended for 0 days.

(21) Appl. No.: 09/367,574

(22) PCT Filed: Feb. 23, 1998

(86) PCT No.: PCT/GB98/00579

§ 371 Date: Nov. 22, 1999

§ 102(e) Date: Nov. 22, 1999

(87) PCT Pub. No.: WO98/37523

PCT Pub. Date: Aug. 27, 1992

(30) Foreign Application Priority Data

Feb. 24, 1997 (GB) ..... 9703768

(51) Int. Cl.[7] ..... G07D 5/08
(52) U.S. Cl. ..... 194/318
(58) Field of Search ..... 194/317, 318

(56) References Cited

U.S. PATENT DOCUMENTS

| | | | | |
|---|---|---|---|---|
| 3,797,307 | * | 3/1974 | Johnston | 194/325 |
| 4,995,497 | | 2/1991 | Kai et al. | 194/318 |
| 5,119,916 | | 6/1992 | Carmen et al. . | |
| 5,263,566 | | 11/1993 | Nara et al. | 194/318 |
| 5,402,873 | | 4/1995 | Ibarrola et al. . | |
| 5,404,987 | * | 4/1995 | Allan et al. | 194/317 |
| 5,609,234 | * | 3/1997 | Walker et al. | 194/317 |
| 5,715,926 | * | 2/1998 | Furneaux et al. | 194/317 |

FOREIGN PATENT DOCUMENTS

| | | |
|---|---|---|
| 0 017 370 | 10/1980 | (EP) . |
| 0 202 378 B1 | 11/1986 | (EP) . |
| 0 710 933 A2 | 5/1996 | (EP) . |
| 2 093 620 | 9/1982 | (GB) . |
| 2 109 975 | 6/1983 | (GB) . |
| WO 93/04448 | 3/1993 | (WO) . |
| WO 93/22747 | 11/1993 | (WO) . |

* cited by examiner

*Primary Examiner*—Robert P. Olszewski
*Assistant Examiner*—Bryan Jaketic
(74) *Attorney, Agent, or Firm*—Fish & Richardson P.C.

(57) ABSTRACT

A device for validating a coin comprises an electro-magnetic sensor, means for monitoring a first signal generated by the sensor and means for deriving a measurement from a second signal generated by the sensor. The event of the first signal taking a predetermined threshold value is used to derive a measurement from the second signal.

20 Claims, 4 Drawing Sheets

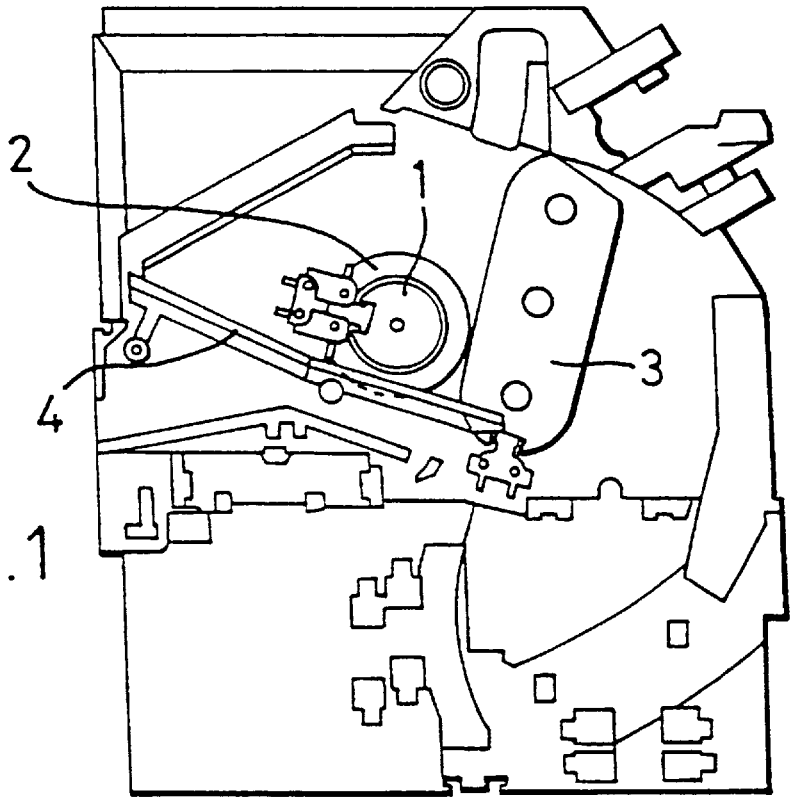
FIG. 1
FIG. 3
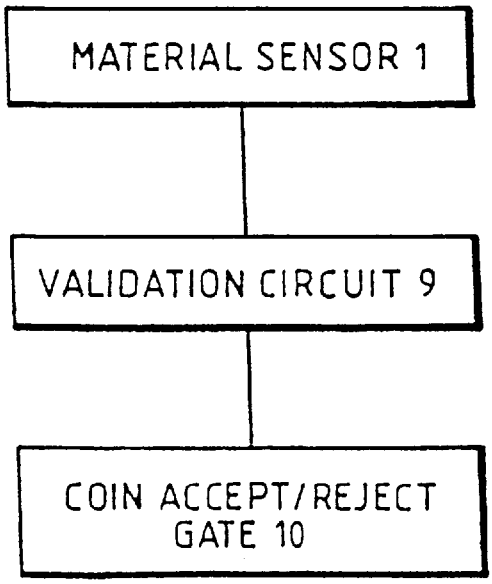

METHOD AND APPARATUS FOR VALIDATING COINS

FIELD OF THE INVENTION

The invention relates to a method and apparatus for validating coins.

BACKGROUND OF THE INVENTION

The invention is intended especially for use in validating coins having an inner, central core made of a first metallic material and an outer ring made of a second metallic material. Such coins are commonly known as bi-colour coins. The invention is also useful for coins having two or more outer rings of different compositions. One or more of the core and outer ring(s) may be formed of layers of two or more materials, in a "clad" construction.

The term coin is used throughout the specification to mean any coin (whether genuine or counterfeit), token, slug, washer, or other metallic object or item, and especially any metallic object or item which could be used in an attempt to operate a coin-operated device or system. A "valid coin" is considered to be an authentic coin, token, or the like, of an acceptable denomination and which a coin-operated device or system is intended selectively to receive and to treat as an item of value, and especially an authentic coin of a monetary system or systems in which or with which a coin-operated device or system is intended to operate.

Various techniques for validating coins and, in particular, for testing the material of coins, are known. Coin testing apparatus is well known in which a coin is subjected to a test by passing it through a passageway in which it enters an oscillating magnetic field produced by an induct-or and measuring the degree of interaction between the coin and the field, the resulting measurement being dependent upon one or more characteristics of the coin and being compared with a reference value, or each of a set of reference values, corresponding to the measurement obtained from one or more denominations of acceptable coins. It is most is usual to apply more than one such test, the respective tests being responsive to respective different coin characteristics, and to judge the tested coin acceptable only if all the test results are appropriate to a single, acceptable, denomination of coin. An example of such apparatus is described in GB-A-2 093 620.

More specifically, it is known from EP 0 710 933 to test bi-colour coins using an inductive sensor, in the form of pair of coils, in combination with two optical sensors. in the apparatus described in EP 0 710 933 the optical sensors are used to control the operation of the inductive sensor to produce a first reading of the coin when the coin is centred on the coils and a second reading when the outer rim portion of the coin is centred on the coils, that is, when the rim portion in combination with other adjacent portions of the coin are in the field of the sensors.

A disadvantage of the device mentioned above is that, if an optical sensor becomes dirty, the accuracy of the timing of the reading of the inductive sensors, which is controlled by the optical sensors, may be reduced. Further, the optical sensor may fail to operate altogether if, for example, the light source or detector is blocked by a piece of dust. Another disadvantage is that the device uses a measurement taken when both the outer rim material and the centre material of the coin, and thus the interface between the two materials, are within the field of the coils for validating the coin. It has been found that the effect on an inductive sensor of a portion of a bi-colour coin including the interface between the two materials changes over the life of a coin, and also it will not necessarily be the same for all coins of the same type, so that coin validation based on a measurement taken over the interface may not be accurate. All the above disadvantages can lead to a valid coin being rejected or an invalid coin accepted.

SUMMARY OF THE INVENTION

The object of the present invention is to mitigate or overcome one or more of the above-mentioned disadvantages.

The present invention provides a device for validating a coin comprising an electro-magnetic sensor, means for deriving first and second signals from the sensor and means for deriving a measurement from the second signal, wherein the event of the first signal taking a predetermined threshold value is used to derive said measurement.

The second signal is representative of the material of a coin passing through the sensor and the first signal can be considered as a trigger which is used to select the appropriate part of the second signal. Because a signal from the electromagnetic sensor itself is used as a trigger, there is no need for external timing triggering means like, for example, the optical sensors in the prior art. Thus, the disadvantages encountered with the optical sensors are eliminated. Also, the device operates with fewer components, which can reduce the cost.

The threshold value can be chosen to trigger measurement for any desired point on a coin. Preferably, the threshold value is chosen to derive a measurement for a non-central portion of a valid coin.

The invention is suitable for validating coins having a central core and more than one outer ring, for example, bi-colour coins.

The first and second signals may be sampled at intervals. Interpolation techniques may be used to derive a measurement from the second signal.

Preferably, the sensor comprises a pair of coils connected in a self-excited oscillator circuit, the coils being arranged opposite each other on either side of a path for a coin. The first signal may represent the oscillator frequency and the second signal the oscillator amplitude. Alternatively, the first signal may represent the oscillator amplitude and the second signal the oscillator frequency.

Preferably, the threshold value is selected to derive a measurement for an outer ring portion of a valid coin. In the case of a bi-colour coin, a measurement is preferably obtained for only the outer ring portion of the coin, that is a measurement obtained when only the outer ring portion of the coin influences the sensor. By deriving a measurement when only the outer rim portion of the coin is next to the sensor, the device avoids the difficulties encountered when taking a "mixed measurement", that is a measurement of both materials of the coin at the same time including the interface.

Preferably, the measurement is taken as the coin moves downstream from the sensor, that is, when the centre of the coin has sassed the centre of the sensor, where the motion of the coin is more stable.

The invention also provides a device for validating a bi-colour coin, wherein the first signal is used to derive a measurement representative of only the outer rim material of a valid coin.

The invention further provides a method for validating a coin comprising deriving first and second signals from a sensor, detecting the event of the first signal taking a predetermined threshold value and using the detection of that event to derive a measurement from the second signal.

The invention also provides a method for validating a coin comprising monitoring a first signal generated by the sensor, and using the first signal to derive a measurement from a second signal generated by the sensor, which measurement is predominantly representative of a non-central portion of a valid coin. Preferably, the method is for validating a bi-colour coin, wherein the first signal is used to derive a measurement representative of only the outer rim material of a valid coin.

BRIEF DESCRIPTION OF THE DRAWINGS

An example of a device for validating coins in accordance with the present invention is described below with reference to the accompanying drawings, of which:

FIG. 1 is a schematic drawing of a coin-sensing area in a coin validating mechanism;

FIG. 3 is a block diagram;

DETAILED DESCRIPTION OF THE INVENTION

Figure 2A:
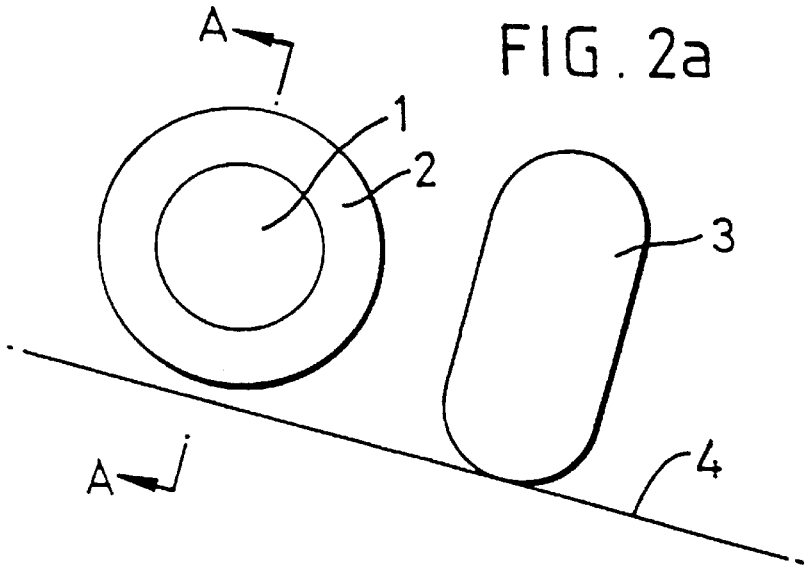
FIG. 2*a* is a simplified detail of FIG. 1.

FIG. 1 shows schematically a coin sensing area within a mechanism for validating coins. As shown in FIG. 2*a*, the sensing area comprises sensors 1, 2, 3 which are used to obtain measurements that are predominantly dependent on the, coin material, coin thickness and coin diameter respectively (referred to hereinafter as the material sensor, thickness sensor and diameter sensor). The sensors 1, 2, 3 are arranged next to and extend normal to a ramp 4 which provides a path for a coin (not shown). The thickness sensor 2 and diameter sensor 3 are known electro-magnetic inductive sensors, operated in accordance with known techniques, and will not be described here in further detail.

Figure 2B:
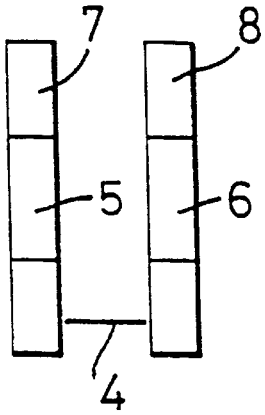
FIG. 2*b* is a cross-section taken along the line A—A of FIG. 2*a;*

As shown in FIG. 2*b*, the material sensor 1 is an electromagnetic inductive sensor comprising a pair of coil assemblies 5, 6 arranged opposite each other on either side of the coin ramp 4 and coupled together. Each coil assembly 5, 6 is arranged within a respective coil assembly 7, 8 of the thickness sensor 2, as described in EP-A-0 489 041. Each coil assembly comprises a coil and a ferrite. The diameter of each coil assembly 5, 6 of the material sensor is approximately llmm, which is smaller than the diameter of the core of ail well-known bi-colour coins currently in circulation.

As represented in block diagram form in FIG. 3, the material sensor 1 is connected to a validation circuit 9 for driving the sensors, processing the signals from the sensors and determining validity and denomination. The validation circuit 9 includes an oscillator (not shown) connected to the coils of the coil assemblies 5, 6 of the material sensor 1, which is used to generate a signal from the coils which is representative of the coin. The circuit 9 also generates suitable output signals including a signal, depending on the outputs from the various sensors 1, 2, 3 for controlling the operation of an accept/reject gate 10 within the coin validation mechanism.

Figure 4:
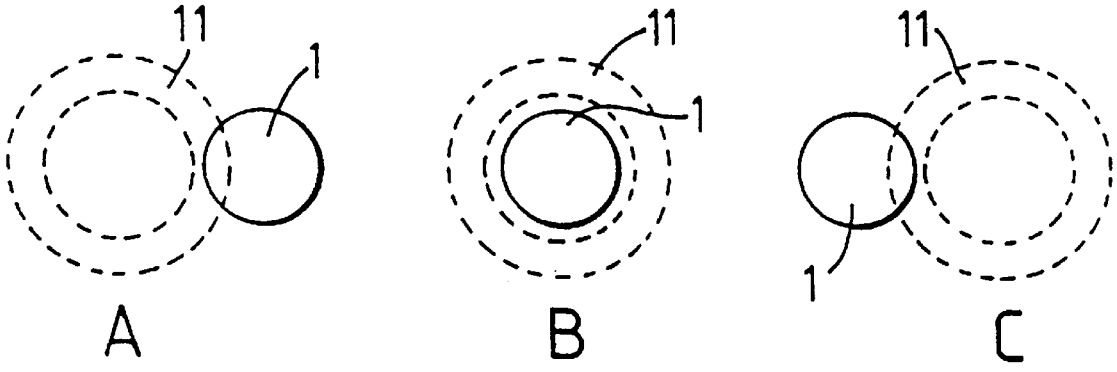
FIG. 4 is a diagram of a coin in a sequence of positions relative to a sensor.
Figure 5:
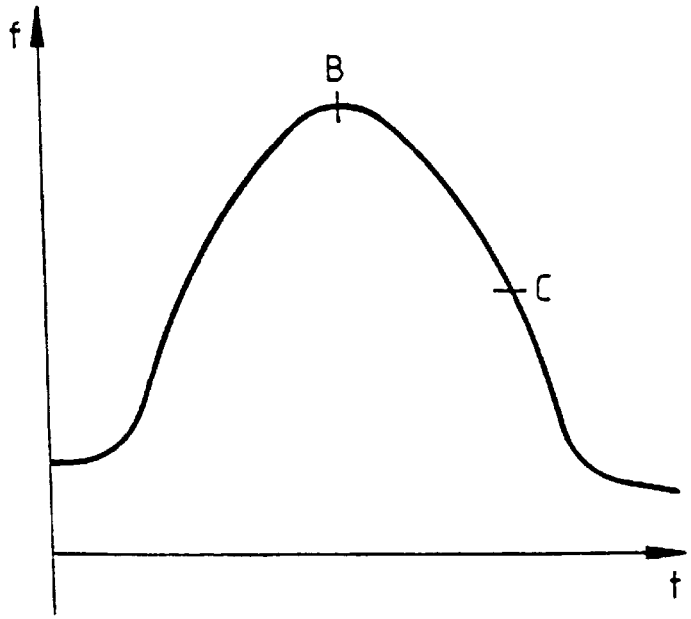
FIG. 5 is a graph showing a first waveform obtained from a coin sensor.
Figure 6:
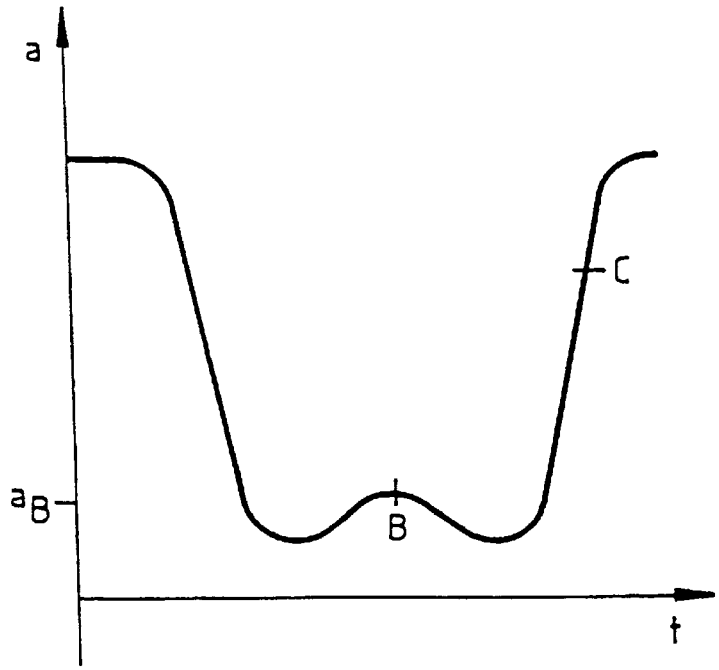
FIG. 6 is a graph showing a second waveform obtained from a coin sensor.

FIG. 4 shows a bi-colour coin 11 in a sequence of different positions relative to the material sensor 1. When any part of a coin is next to the sensor 1, it influences the inductance and resistance of the coils in the sensor which in turn affects the frequency and amplitude of the oscillator output. As the coin passes through the field produced by the coils, the frequency and amplitude in the oscillator output change. A first signal, which represents the changing frequency of the signal in the oscillator, and a second signal, representing the changing amplitude, are generated in the validation circuit 9, and example waverforms for those signals are shown in FIG. 5 and FIG. 6. The first signal represents a relationship (for example, the difference or the ratio) between the frequency of the oscillator at any given time and the idle frequency (that is, the frequency when there is no coin influencing the sensor) and is known as the "frequency shift". Similarly, the second signal represents a relationship (for example, the difference or ratio) between the actual amplitude of the oscillator output and the idle amplitude and is known as the "amplitude shift". The sensor is driven at low frequencies, that is frequencies below about 120 kHz.

As different coins pass through the sensor 1, different frequency and amplitude signals are generated, having waveforms dependent on the characteristics of the coin. As described below, for any given coin inserted into the validator, the frequency and ampl-tude signals are monitored and two values, representative of the coin, are derived from the amplitude signal and used to test the coin.

The frequency signal is used to derive a measuremen from the second signal by using a threshold value as a "trigger". The threshold value is the value of the frequency signal when only the outer rim portior of a valid coin is next to the sensor, as determined by calibration, so that, for subsequent valid coins, a measurement is derived for that same point, giving a measurement representative of only the outer material.

When a coin is inserted in the validator, the validation circuit monitors the frequency signal to detect when the signal crosses that threshold value. In this example, the signal is monitored to detect when the signal crosses the threshold value and is decreasing, that is, for a valid coin, when the coin is at the point C in FIG. 4 so that only the trailing edge of the coin is next to the sensor. A measurement for that point is then derived from the values of the amplitude signal, as described in more detail below, and that measurement is representative of only the outer rim material of the coin.

The frequency and amplitude signals are sampled at a constant rate once every millisecond, and the sampled values are stored and monitored by the validation circuit.

Figure 7A:
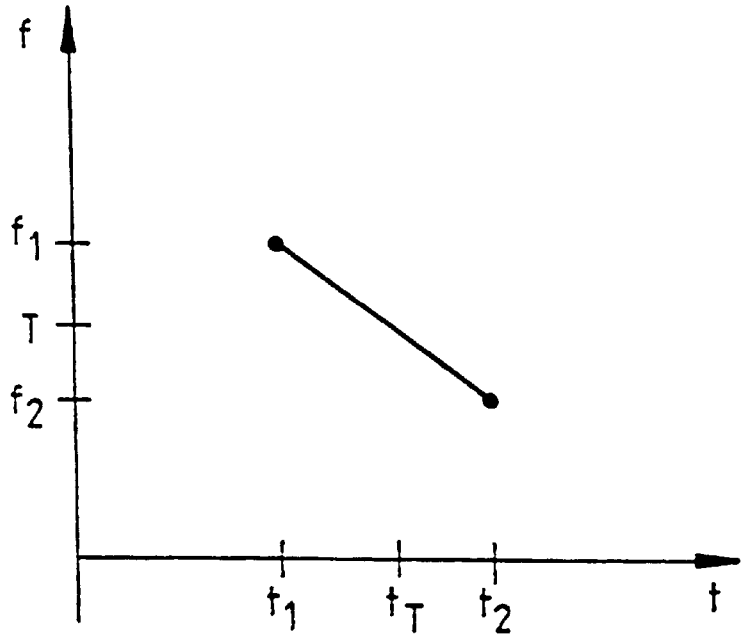
FIG. 7*a* is a diagram showing a detail of the waveform of FIG. 5.
Figure 7B:
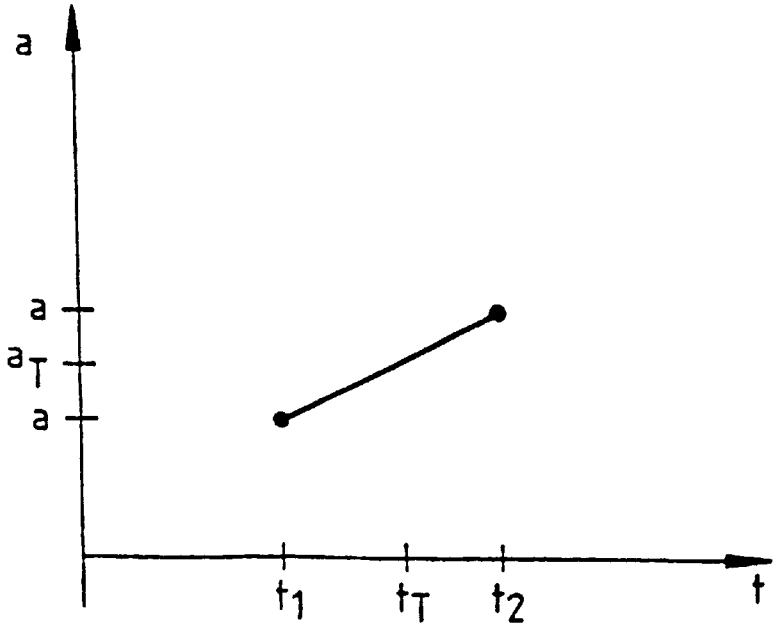
FIG. 7*b* is a diagram showing a detail of the waveform of FIG. 6.

A measurement is derived from the sampled amplitude signal using an interpolation method which will be described with reference to FIGS. 7*a* and 7*b* which show an approximation of the frequency signal in the region of the threshold value and the corresponding amplitude signal respectively. When a sampled value of the frequency signal falls below the threshold value (T), that sampled value ($f_2$), the previous sampled value of the frequency signal ($f_1$) and the corresponding sampled values of the amplitude signal ($a_2$ and $a_1$) are selected or retrieved from the store. A value for the amplitude signal a, at the point $t_T$ at which the frequency signal took the threshold value can be obtained using interpolation, in accordance with the equation:

$$a_T = (T - f_2)\frac{(a_1 - a_2)}{(f_1 - f_2)} + a_2$$

and the value $a_t$ so obtained is used to validate the coin, as described below.

The sampling rate is relatively fast having regard to the rate of change of the frequency signal, so that the approximations are sufficiently accurate.

The sampling rates and/or times of sampling of the frequency signal and the amplitude signal need not be the same. The amplitude signal may, for example, be sampled asynchronously.

The validation circuit also monitors the amplitude signal to detect when the coin is centred on the sensor (point B on FIGS. 4, 5 and 6) and takes a measurement from the amplitude signal, $a_B$, at that point. There are known techniques for detecting when a coin is centred on the sensor, which is indicated by a local maximum in the amplitude signal. The size of the coils of the material sensor is such that the outer rim of a valid coin does not influence the coils when the centres coincide. Thus, a measurement of the amplitude signal at point B is representative of the centre material of the coin.

In the manner described above, two representative values, $a_T$, and $a_B$, are obtained from the amplitude signal, which are values for the outer rim material and for the centre material.

The values $a_T$ and $a_B$ are used to validate the can by comparing them with stored acceptability data, in the form of "windows", that is, stored upper and lower limits (see GB 1 452 740). A first window is provided for the value $a_T$ and a second window for the value $a_B$. If, for a given coin, each of the values $a_T$. and $a_B$ falls within the respective window (and the measurements from the sensors 2 and 3 are also deemed acceptable), then the coin is deemed to be valid and the validation circuit generates a "coin accept" signal which controls the coin accept/reject gate.

The apparatus can be adapted to validate a different bi-colour coin by adjusting the stored acceptability data. Such adaptation can be achieved simply by altering the software used in a control means and does not require the hardware to be changed. The apparatus can also be used to validate more than one bi-colour coin type, using a different threshold value for each of the coins to be validated, the value obtained at each threshold point being compared with a respective window. By using several threshold points to trigger a material measurement, it is possible to identify where the material of a coin changes, so that, for example, the width of the outer ring of a bi-colour coin can be calculated.

Various modifications to the device described above are possible.

More particularly, other methods for using the representative values to validate the coin could be used. The acceptability data could instead represent a predetermined value such as a median, the measurements then being tested to determine whether or not they lie within predetermined ranges of that value.

Alternatively, the acceptance data could be used to modify each measurement and the test would then involve comparing the modified result with a fixed value or window. Alternatively, the acceptance data could be a look-up table which is addressed by the measurements, and the output of which indicates whether the measurements are suitable for a particular denomination (see, for example, EP-A-0 480 736 and U.S. Pat. No. 4,951,799).

Instead of having separate acceptance criteria for each test, the measurements may be combined and the result compared with stored acceptance data (see, for example, GB-A-2 238 152 and GB-A-2 254 949). Alternatively, some of these techniques could be combined, for example, by using the acceptability data as co-efficients (derived, for example, using a neural network technique) for combining the measurements, and possibly for performing a test on the result.

Alternatively, instead of using two values selected from the amplitude signal, validation could be performed using the value $a_T$ from the amplitude signal and the value of the frequency signal at the point when the coin is centred on the coils, which also gives a value representative of the centre material. Again the values so obtained could be used separately or in combination.

In all the above modifications, the roles of the frequency signal and the amplitude signal could be reversed, so that the amplitude signal functions as the trigger and vice versa. Other signals from a sensor influenced by a coin could be monitored, for example, the real and imaginary component of the impedance of an inductor, as described in GB-A-2 287 341, or the amplitude and phase shift, as described in GB-A-2 244 837.

It is not necessary to use two coils. A sensor comprising only one coil, as described, for example, in GB-A-2 266 399, could be used.

The invention is not limited to use in validating bi-colour coins. The techniques and apparatus described can be adapted for deriving a measurement for any given point on a particular coin, using one or more predetermined threshold values. Thus, the apparatus could be used, for example, for taking a measurement of each ring of a coin having two or more concentric rings of different material, or for validating a coin with a hole in the middle.

Our co-pending application, GB 9703769.1, entitled "Coin Validator" filed on Feb. 24th 1997, also relates to validating bi-colour coins, and the contents of that document are incorporated herein by reference.

What is claimed is:

1. A device for validating a coin comprising an electromagnetic sensor, means for deriving first and second signals from the sensor and means for deriving a measurement from the second signal, wherein the event of the first signal taking a predetermined threshold value is used to derive said measurement.

2. A device as claimed in claim 1 wherein the threshold value is selected to derive a measurement for a non-central portion of a valid coin.

3. A device as claimed in claim 1 wherein the first signal is used to select a period from the second signal and a measurement is derived from said selected period.

4. A device as claimed in claim 1 wherein the first and second signals are sampled at intervals and interpolation techniques are used to derive a measurement from the second signal.

5. A device as claimed in claim 1 wherein the sensor comprises a coil arranged on one side of a path for a coin.

6. A device as claimed in claim 5 wherein the sensor comprises a pair of coils connected in an oscillator circuit, the coils being arranged opposite each other on either side of a path for a coin.

7. A device as claimed in claim 6 wherein the first signal represents the oscillator frequency and the second signal represents the oscillator amplitude.

8. A device as claimed in claim claim 6 wherein the first signal represents the oscillator amplitude and the second signal represents the oscillator frequency.

9. A device as claimed in claim 1 for validating a coin comprising two or more concentric rings of two or more different materials, wherein the threshold value is selected to derive a measurement for an outer ring portion of a valid coin.

10. A device as claimed in claim 9 for validating a bi-colour coin wherein the threshold value is selected to derive a measurement for only the outer ring portion of a valid coin.

11. A device as claimed in claim 1 wherein the measurement is taken as the coin moves downstream of the sensor.

12. A device as claimed in claim 1 adapted to derive a measurement for the centre of material of a valid coin.

13. A device as claimed in claim 1 comprising a store of acceptance data representative of a bi-colour coin.

14. A device as claimed in claim 1 comprising a store of a plurality of threshold values.

15. A device as claimed in claim 14 for validating two or more different types of bi-colour coins.

16. A device as claimed in claim 1 wherein predetermined threshold values are used to measure the width of a portion of a coin.

17. A device for validating a coin comprising an electromagnetic sensor and means for deriving first and second signals from the sensor, wherein the first signal is used to derive a measurement from the second signal, which measurement is predominantly representative of a non-central portion of a coin.

18. A device as claimed in claim 17 for validating a bi-colour coin, wherein the first signal is used to derive a measurement representative of only the outer rim material of a valid coin.

19. A method for validating a coin comprising deriving first and second signals from a sensor, detecting the event of the first signal taking a predetermined threshold value and using the detection of that event to derive a measurement from the second signal.

20. A method for validating a coin comprising monitoring a first signal generated by a sensor, and using the first signal to derive a measurement from a second signal generated by the sensor, which measurement is predominantly representative of a non-central portion of the coin.

* * * * *